US012050076B1

(12) United States Patent
Holen

(10) Patent No.: US 12,050,076 B1
(45) Date of Patent: Jul. 30, 2024

(54) FIREARM CHARGING HANDLE DEVICE

(71) Applicant: Gary Holen, Whitehall, WI (US)

(72) Inventor: Gary Holen, Whitehall, WI (US)

( * ) Notice: Subject to any disclaimer, the term of this patent is extended or adjusted under 35 U.S.C. 154(b) by 0 days.

(21) Appl. No.: 18/378,708

(22) Filed: Oct. 11, 2023

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 99/00
USPC ..... 89/1.4; 42/90, 106
See application file for complete search history.

(56) References Cited

U.S. PATENT DOCUMENTS

| | | | | |
|---|---|---|---|---|
| 5,551,179 | A | 9/1996 | Young | |
| 6,311,603 | B1 | 11/2001 | Dunlap | |
| 7,231,861 | B1 | 6/2007 | Gauny et al. | |
| 7,240,600 | B1 | 7/2007 | Bordson | |
| 7,461,581 | B2 | 12/2008 | Leitner-Wise | |
| 7,707,921 | B1 | 5/2010 | Hoel | |
| 7,798,045 | B1 | 9/2010 | Fitzpatrick et al. | |
| 7,900,546 | B2 | 3/2011 | Bordson | |
| 8,667,883 | B1 | 3/2014 | Larson et al. | |
| 8,960,066 | B2 | 2/2015 | Gomez | |
| 9,016,188 | B2 | 4/2015 | Larson et al. | |
| 9,354,004 | B2 * | 5/2016 | Brubaker | F41A 35/06 |
| 9,366,489 | B1 | 6/2016 | Strom | |
| 9,377,258 | B2 | 6/2016 | Gomez | |
| 9,435,593 | B2 | 9/2016 | McGinty | |
| 9,482,479 | B1 | 11/2016 | Jen | |
| 9,500,421 | B1 | 11/2016 | Geissele | |
| 9,587,896 | B1 | 3/2017 | Huang | |
| 9,677,833 | B2 | 6/2017 | Kincel | |
| 9,739,549 | B2 | 8/2017 | Kincel | |
| 9,759,502 | B2 | 9/2017 | Sugg et al. | |
| 9,897,406 | B2 | 2/2018 | Oz et al. | |
| 9,995,543 | B2 | 6/2018 | Underwood | |

(Continued)

FOREIGN PATENT DOCUMENTS

| | | |
|---|---|---|
| CA | 3036538 | 3/2018 |
| WO | 2017118969 | 7/2017 |

(Continued)

OTHER PUBLICATIONS

FuYing Bro, "AR-15 Gas Blow Back Fix," https://www.youtube.com/watch?v=KvytCG8654k, published Sep. 3, 2014 (1 page).

(Continued)

*Primary Examiner* — Reginald S Tillman, Jr.
(74) *Attorney, Agent, or Firm* — Boyle Fredrickson, S.C.; Kirk L. Deheck

(57) ABSTRACT

A firearm charging handle shroud is defined by a body that is formed of an elastically deformable material and is constructed to be secured to a charging handle by the respective left hand and right-hand charging handle pulls when a charging handle is engaged with an underlying firearm. The shroud wraps generally about a rearward facing surface of a charging handle and is constructed to extend across the interfacing surfaces between a charging handle and an underlying receiver of a firearm. During use, the shroud operates to prevent egress of and/or diversion of gunshot discharge byproducts in directions away from the face of a user of a firearm.

19 Claims, 6 Drawing Sheets

(56) References Cited

U.S. PATENT DOCUMENTS

| | | | |
|---|---|---|---|
| 10,001,332 | B1 | 6/2018 | Friend |
| 10,006,728 | B2 | 6/2018 | Bailey |
| 10,012,461 | B2 | 7/2018 | Curry |
| 10,161,697 | B1 | 12/2018 | Underwood et al. |
| 10,190,834 | B2 | 1/2019 | Smith et al. |
| 10,203,174 | B2 | 2/2019 | Underwood |
| 10,247,496 | B2 | 4/2019 | Kincel |
| 10,337,811 | B1 | 7/2019 | Underwood et al. |
| 10,677,549 | B2 | 6/2020 | Kincel et al. |
| 10,697,721 | B2 | 6/2020 | Kincel |
| 11,009,302 | B1 | 5/2021 | Mayer et al. |
| 11,015,886 | B1 | 5/2021 | Lee |
| 11,187,476 | B2 | 11/2021 | Jung |
| 11,248,862 | B2 | 2/2022 | Frazier et al. |
| 11,274,889 | B2 | 3/2022 | Hubbell et al. |
| 11,346,623 | B2 | 5/2022 | Bray et al. |
| 11,703,293 | B2 | 7/2023 | Torgersen |
| 2011/0005372 | A1 | 1/2011 | Kincel |
| 2011/0036232 | A1 | 2/2011 | Dublin |
| 2011/0214558 | A1 | 9/2011 | Kincel |
| 2011/0226120 | A1 | 9/2011 | Fitzpatrick et al. |
| 2013/0092014 | A1 | 4/2013 | Kincel |
| 2016/0061542 | A1 | 3/2016 | Daley, Jr. et al. |
| 2016/0153731 | A1 | 6/2016 | Sugg |
| 2016/0258698 | A1 | 9/2016 | Seuk |
| 2016/0320151 | A1 | 11/2016 | Kincel |
| 2017/0023321 | A1 | 1/2017 | Kincel |
| 2017/0191773 | A1 | 7/2017 | Oz et al. |
| 2017/0299294 | A1 | 10/2017 | Underwood |
| 2017/0336158 | A1 | 11/2017 | Kincel |
| 2018/0010868 | A1 | 1/2018 | Bailey |
| 2018/0259277 | A1 | 9/2018 | Underwood |
| 2020/0080802 | A1 | 3/2020 | Jennings |
| 2020/0292258 | A1 | 9/2020 | Hubbell et al. |
| 2021/0080202 | A1 | 3/2021 | Jung |
| 2021/0156634 | A1 | 5/2021 | Lee |
| 2021/0172692 | A1 | 6/2021 | Frazier et al. |
| 2021/0222972 | A1 | 7/2021 | Bray et al. |
| 2021/0381785 | A1 | 10/2021 | Underwood et al. |

FOREIGN PATENT DOCUMENTS

| | | |
|---|---|---|
| WO | 2018049393 | 3/2018 |
| WO | 2021202127 | 10/2021 |

OTHER PUBLICATIONS

Gun Talk Media, "Allowing for Gas Blowback from a Suppressed AR," https://www.youtube.com/watch?v=pLwksfck3E8, published May 8, 2020 (1 page).

Guns & Tactics, "Gas Buster Charging Handle DIY—No Gas in Face!", https://www.youtube.com/watch?v=wancMz8ZDg8, published Dec. 10, 2016 (1 page).

Gun Talk Media, "A Special Ambi Charging Handle for Suppressed Guns | GunDealio Deal Alert," https://www.youtube.com/watch?v=elhN4oCsF_w, published Sep. 7, 2020 (1 page).

SilencerCO, "SilencerCO—Gas Defeating Charging Handle—That Actually Works," https://www.youtube.com/watch?v=gliq0URkxCo, published Feb. 10, 2022 (1 page).

* cited by examiner

FIREARM CHARGING HANDLE DEVICE

FIELD OF THE INVENTION

The present invention relates generally to firearms and, more particularly, to a firearm charging handle device that does not interfere with operation of the charging handle relative to an underlying firearm and operates to mitigate blowback associated with operation of the firearm being directed toward the face of a user of the firearm.

BACKGROUND OF THE INVENTION

Charging handles, also known as cocking or bolt handles, are common in many firearm platforms and configurations and allow for manual operation of a bolt associated with operation of an underlying firearm when desired. Rearward manual translation of the charging handle relative to the receiver assembly of the firearm effectuates rearward translation of the bolt of the firearm thereby opening the breech of the firearm, commonly cock the hammer or striker supported by the bolt and exposes the firearm firing chamber. Rearward translation of the charging handle, and the resultant rearward translation of the bolt allows the user to visually inspect the breech of the firearm, clear any jams, and verify the condition of the firing chamber as being clear and ready to accept a subsequent cartridge when necessary.

In some firearm configurations, manual operation of the charging handle is necessary to effectuate extraction of each spent casing and introduction of a subsequent round of ammunition to the firing chamber. Other firearm configurations, capable of semi-automatic and/or automatic operation, commonly include a spring arrangement and/or direct a portion of the combustion gas associated with discharge of each cartridge in a rearward direction to effectuate the cyclic operation of the bolt of the underlying firearm to extract spent casings from the firing chamber and introduction of a subsequent round of ammunition thereto upon return of the bolt to the firing position. User interaction with the charging handle isn't necessary to effectuate the cyclic operation of such firearms during automatic or semiautomatic operation during discharge of available ammunition and the charging handle may or may not move relative the receiver assembly during the slideable operation of the bolt. When maintained in the relatively fixed orientation relative to the receiver, the charging handle can include a catch or latch configured to maintain the charging handle in a "closed" or forward position relative to the receiver until inspection of the breech or reloading of the firearm is desired. Upon discharge of available ammunition, user interaction with the catch or latch of the charging handle allows manual slideable operation of the charging handle relative to the receiver assembly to effectuate the desired forward or rearward operation of the bolt relative to the receiver. Many firearms are provided in right-hand operable, left-hand operable, and/or ambidextrously operable charging handle catch or latch arrangements.

During cyclic operation of a firearm, ammunition combustion byproducts, unspent combustion charge products, microscopic casing and projectile fragments have a tendency to linger and/or collect about the surfaces and mechanisms disposed proximate the breech, firing chamber, bolt, charging handle, and receiver assembly of the firearm. Each subsequent discharge associated with operation of the firearm can produce backpressures and flows that encourage propagation of the byproducts associated with firearm operation in rearward directions toward the user. Although heavier and/or slower moving particulate matter may drop into the receiver and/or magazine assemblies, portions of the discharge gases and particulate matter can travel in rearward directions toward the interface of the charging handle with the receiver assembly. There at, portions of the rearward traveling gasses and particulate matter tend to exit the firearm assembly at interfaces between the various movable parts thereof. Egress of the firearm discharge byproducts associated with firearm operation in areas about the charging handle can adversely affect the user's interaction with the underlying firearm.

During use of many firearms, the user's face is commonly positioned in close proximity to the rearward facing surface of the charging handle and the receiver assembly positioned thereabout for sighting operations and use of auxiliary sighting devices such as iron sights, scopes, and other optic devices employed to attain the desired alignment and inclination of the firearm relative to an intended target. When the user's face is positioned near the accessible interaction of the charging handle and the receiver assembly, even though the charging handle may be secured in the closed orientation relative to the receiver assembly, the rearward directed byproducts associated with discharge of the firearm tend to exit the receiver assembly in areas generally about the charging handle and tend to be directed directly toward the face, and thereof the eyes, of the user. Even ejection of minor amounts of discharge byproducts in the direction of the user's face can detrimentally affect the user's ability to accurately visually acquire targets and interact with firearm sighting devices. Such shortcomings can be exacerbated if lesser quality ammunition is used, when reasonable firearm cleaning processes are not adhered to, during periods of heavy usage of the firearm between cleaning operations, and/or dusty or sandy shooting conditions. Accordingly, there is a need for a device that mitigates the egress and/or diverts discharges of shooting byproducts toward the user.

Various attempts have been made to mitigate the detriments of byproducts associated with shooting operations from being directed toward users. Each of the various approaches suffers from various drawbacks and are not necessarily unique to any given approach. U.S. Pat. Nos. 11,793,293; 10,247,496; and 9,677,833 each disclose respective charging handle assemblies that include a seal that is constructed to be disposed between the interface of the respective charging handle and the underlying receiver with which the charging handle is configured to cooperate. Each charging handle is constructed to include a channel that receives the seal such that the seal is disposed generally between the charging handle and the receiver. In some approaches the seal device is supported by a uniquely constructed charging handle and in other approaches the sealing device is supported by a uniquely constructed receiver assembly. Such approaches require users or firearm owners to replace the original equipment manufacturer (OEM) charging handle and/or receiver with the charging handle and/or receiver having the respective seal device, and which is constructed to cooperate with the particular firearm owned. Such approaches increase both manufacturing costs as well as end user costs associated with incorporating such approaches into already owned firearms.

Furthermore, repeated "opening" and "closing" of the charging handle during normal operation of the firearm can result in degradation of performance of the sealing device. That is, limiting egress of discharge byproducts from the firearm tends to lead to collection of the debris within the confines of the receiver assembly. Unaddressed, such collection can lead to premature fouling of the mechanisms associated with operation of the firearm. Further, repeated opening and closing of the charging handle tends to translate larger byproduct particulates into those areas associated with the sealed interaction between the charging handle and the receiver. Collection of the discharge byproducts within the areas associated with the interface of the seal structure can debride the seal surface and degrade the sealing performance thereof. Further still, for those configurations that provide non-circumferential seal arrangements, collection of discharge byproducts can become localized toward non-sealed areas and increase the potential of localized discharge byproduct fouling associated with continued operation of the firearm and leave various portions associated with slideable interaction between the charging handle and receiver unhindered to the egress of shooting byproducts.

Still other approaches to mitigate egress of shooting byproducts about the exterior of the charging handle and toward the face of the user are disclosed in U.S. Pat. Nos. 11,187,476; 10,677,549; 10,203,174; 10,012,461; 10,006,728; 9,995,543; 9,500,421; and 9,482,479. Each of the patents above disclose charging handle assemblies wherein a portion of the discrete charging handles is constructed to include one or more ports, channels, or diverter structures that are constructed to divert shooting byproducts in directions away from the face of the user. Like the preceding patents, each of the assemblies disclosed in this second group of patents utilize methodologies that require user replacement of at least the OEM charging handle and occasionally replacement of the OEM firearm receiver assembly in those instances wherein the receiver assembly is uniquely constructed to cooperate with the respective charging handle assembly. Such approaches likewise increase manufacturing costs and further increase user expense associated with employment of such approaches.

Further still, the slideable operation of the charging handle relative to the receiver, operative interaction of the charging handle with the bolt of the firearm, and moveable operation of any respective catches or latches of the charging handle with the receiver to maintain a desired "closed" orientation of the charging handle relative to the receiver during operation of the firearm spatially limit both the dimensioning and positioning of the byproduct discharge directing structures of the discrete ports, channels, or diverters associated with those charging handles that operate in such methodologies. The various channels, passages and/or ports associated with such approaches are sized and positioned to localize the travel paths associated with handling of the discharge byproducts. The localization of the discharge byproducts into confined passages and/or ports can lead to plugging of the ports thereby rendering the approach of byproduct directing inoperable, lead to premature fouling of the firearm operating systems, and/or complicate firearm cleaning and service operations.

There is therefore a need for a firearm device that is operable to prevent or divert cartridge discharge byproducts from being directed toward the face of the user, is configured to cooperate with various OEM firearm devices without requiring replace of discrete portions thereof, has a negligible impact on firearm fouling, and/or does not interfere with the intended movable and securable operation of OEM charging handle assemblies and in a manner that is independent of the right-handed, left-handed, and/or ambidextrous operation thereof.

SUMMARY OF INVENTION

The present invention discloses a firearm charging handle shroud that is constructed to removably cooperate with charging handles having a variety of constructions and operable to mitigate instances of blowback associated with operation of the firearm from being directed toward a face of a user. The charging shroud is defined by a body that is formed of an elastically deformable material. The device is constructed to be secured to a charging handle by respective left hand and right-hand charging handle pulls when a charging handle is operationally engaged with an underlying firearm. The shroud wraps generally about a rearward facing surface of a charging handle and is constructed to generally seal the lower oriented interface between a charging handle and an underlying receiver of a firearm and preferably extends above an upper surface of a rearward facing portion of the charging handle. During use, the shroud operates to prevent egress of and/or divert gunshot residue from traveling in directions toward the face of a user of a firearm.

Another aspect of the present invention discloses a firearm charging handle shroud that is defined by a body formed by a flexible material. The body is defined by a thickness, a width, and a length wherein the thickness is oriented to be generally aligned with an axis associated with the slidable operation of a charging handle engaged with a firearm. The width of the body is configured to be oriented in a general vertical plane and is dimensioned to extend at least below a lower surface of a handle portion of a charging handle. The length of the body extends in a crossing direction relative to the width and the thickness of the body. A first opening and a second opening are formed through the body and each extends in a direction aligned with the width of the body. The first opening and the second opening are oriented such that the first opening and the second opening are offset from one another along the length of the body. The first opening and the second opening are oriented to be selectively engaged with a respective one of a left side pull and a right side pull of a charging handle and secure the body to an underlying firearm such that the body extends rearward of a charging handle.

A further aspect of the present invention that is usable or combinable with one or more of the above features or aspects discloses a firearm charging handle shroud that includes a body formed of a flexible material and having a unitary construction. A first opening and a second opening are formed through the body at generally opposite longitudinal ends thereof. Each of the first opening and the second opening are constructed to receive a respective charging handle pull therethrough and spaced from one another such that a portion of the body between the first opening and the second opening elastically deforms when the first opening and the second opening are engaged with a charging handle.

Another aspect of the present invention that is usable or combinable with one or more of the features or aspects disclosed above discloses a method of manipulating direction of travel of residue or byproducts attributable to discharge of a firearm. The method includes providing a body that is formed of a flexible material. The body is shaped to removeably cooperate with a charging handle of a firearm such that the body wraps about a rearward facing portion of a charging handle when a charging handle is engaged with a firearm such that an upper edge and a lower edge of the body extends beyond respective upper and lower edges of a rearward facing portion of a charging handle engaged with a firearm.

These and other features, aspects, and advantages of the present invention will be better understood from the following brief description of the drawings, drawings, and detailed description of the preferred embodiments of the present invention.

BRIEF DESCRIPTION OF THE DRAWINGS

The drawings illustrate preferred embodiments presently contemplated for carrying out the invention.

In the drawings.

DETAILED DESCRIPTION OF THE PREFERRED EMBODIMENT

Figure 1:
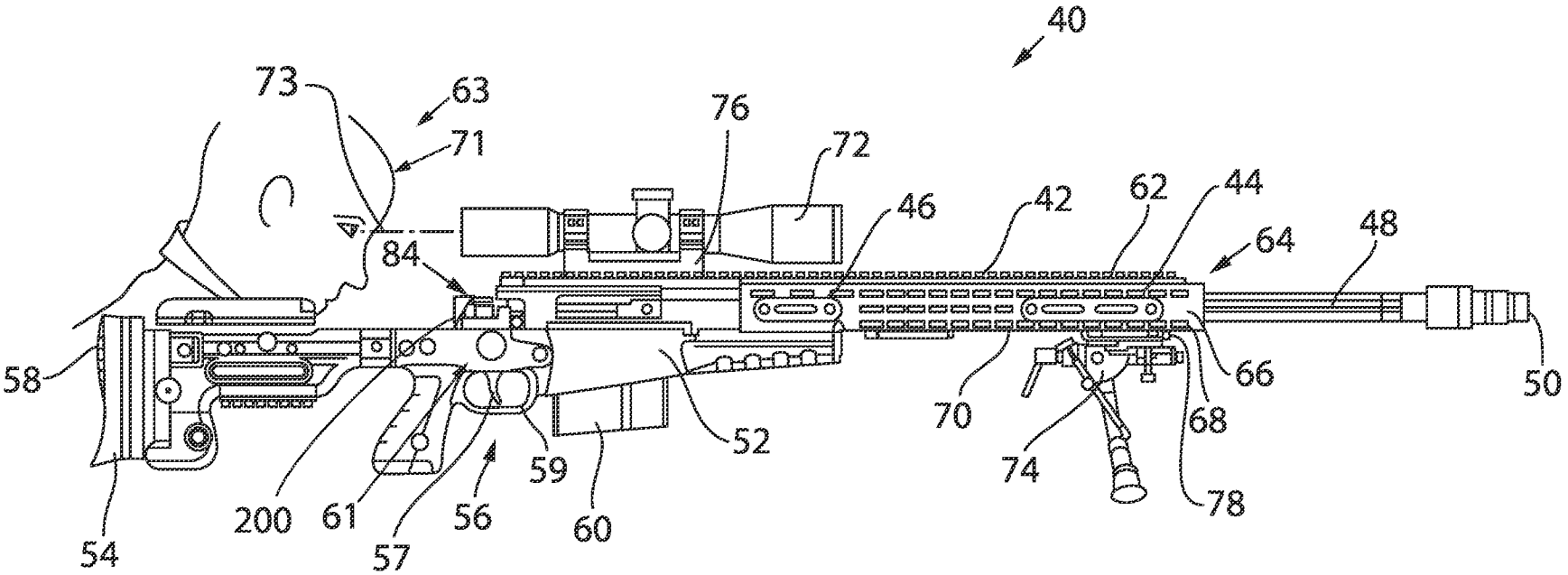
FIG. 1 is a right-side elevation view of an exemplary firearm equipped with a charging handle shroud according to the present invention.

FIG. 1 shows an exemplary firearm assembly or simply a firearm 40 having a firearm charging handle shroud or shroud 200 (FIGS. 4-5) according to the present invention engaged therewith. As disclosed in further detail below, when engaged with a respective underlying firearm 40, shroud 200 is preferably constructed to extend above, below, and about a rearward facing surface of a respective charging handle engaged with the underlying firearm receiver assembly. It is appreciated that firearm 40 can be provided in various constructions, calibers, and configurations suitable for cooperation with charging handle device 200. Firearm 40 includes a barrel 48 that extends between a muzzle 50 and receiver or receiver assembly 52. A stock 54 extends generally rearward from receiver assembly 52. Receiver assembly 52 supports a trigger assembly 56 such that trigger assembly 56 is disposed between a butt 58, defined by stock 54 of firearm 40, and barrel 48. Trigger assembly 56 includes a trigger body 57 that is preferably bounded by a trigger guard 59 configured to limit unintended interaction with trigger body 57.

Firearm 40 can include a magazine 60 that is commonly associated with accommodating multiple rounds of ammunition and is commonly removable from receiver assembly 52. As is commonly understood, user 63 interaction with trigger body 57 of trigger assembly 56 is associated with discharging firearm 40 when a fire control selector assembly or selector 61, commonly termed a SAFETY or FIRE selector, is disposed in one or more FIRE of LIVE position (s). It is appreciated that the various structures of receiver assembly can be provided in various configurations intended to accommodate a no-fire or safe condition, a semiautomatic fire condition, a burst fire condition, and/or a fully automatic fire condition. Those skilled in the art readily appreciate that the respective fire conditions are termed in a manner indicative of a discharge rate or an inability to discharge ammunition from firearm 40 via user 63 interaction with trigger body 57.

In some configurations, firearm 40 can include a hand guard 42 that extends along barrel 48 generally forward of receiver assembly 52 and can include one or more rows of engagement interfaces 62, 64, 66, 68, 70 and/or mount adapters 44, 46 associated with securing accessories to firearm 40. One or more accessories 72, 74, such as optics, such as a sight or a scope 72, or other accessories such as a bi-pod 74, can be associated with a respective accessory mount devices 76, 78 disposed between the respective accessory 72, 74 and the underlying accessory engagement interface.

Each accessory mount device 76, 78 is constructed to securely cooperate with a respective engagement interface 62, 64, 66, 68, 70 associated with the underlying hand guard 42. Although shown as a scope and a bi-pod, it is appreciated that various accessories, such as lights, other sighting devices, supplemental ammunition, etc., can be supported by hand guard 42 or other portions of firearm 40 provided the respective accessories are configured to cooperate with or be secured to a respective engagement interface 62, 64, 66, 68, 70 associated with hand guard 42 or other structures of firearm 40.

It is appreciated that charging handle shroud 200 (FIGS. 4-5) as described hereafter can be configured to be useable with firearms and, more particularly, firearm charging handle assemblies, of various constructions, configurations, various calibers, and with various accessories. As described hereafter, although exemplary firearm receiver assembly 52 is preferably configured to accommodate ambidextrous operation of various control features associated with an intended or desired use of firearm 40, it is appreciated that charging handle shroud 200 is usable and operable in generally the same manner whether a respective firearm is provided for right-handed operation, left-handed operation, and/or ambidextrous operation of the underlying firearm. As shown in FIG. 1, although firearm 40 is shown as being configured for operation by a right-handed user, whether used by right handed or left handed user's 63; during sighting and shooting operations, a face 71, and particularly an eye 73, of user 63 is commonly positioned in close proximity to, but rearward of charging handle assembly 84 associated with underlying firearm 40 for desired use of sighting accessories such as scope 72.

Figure 2:
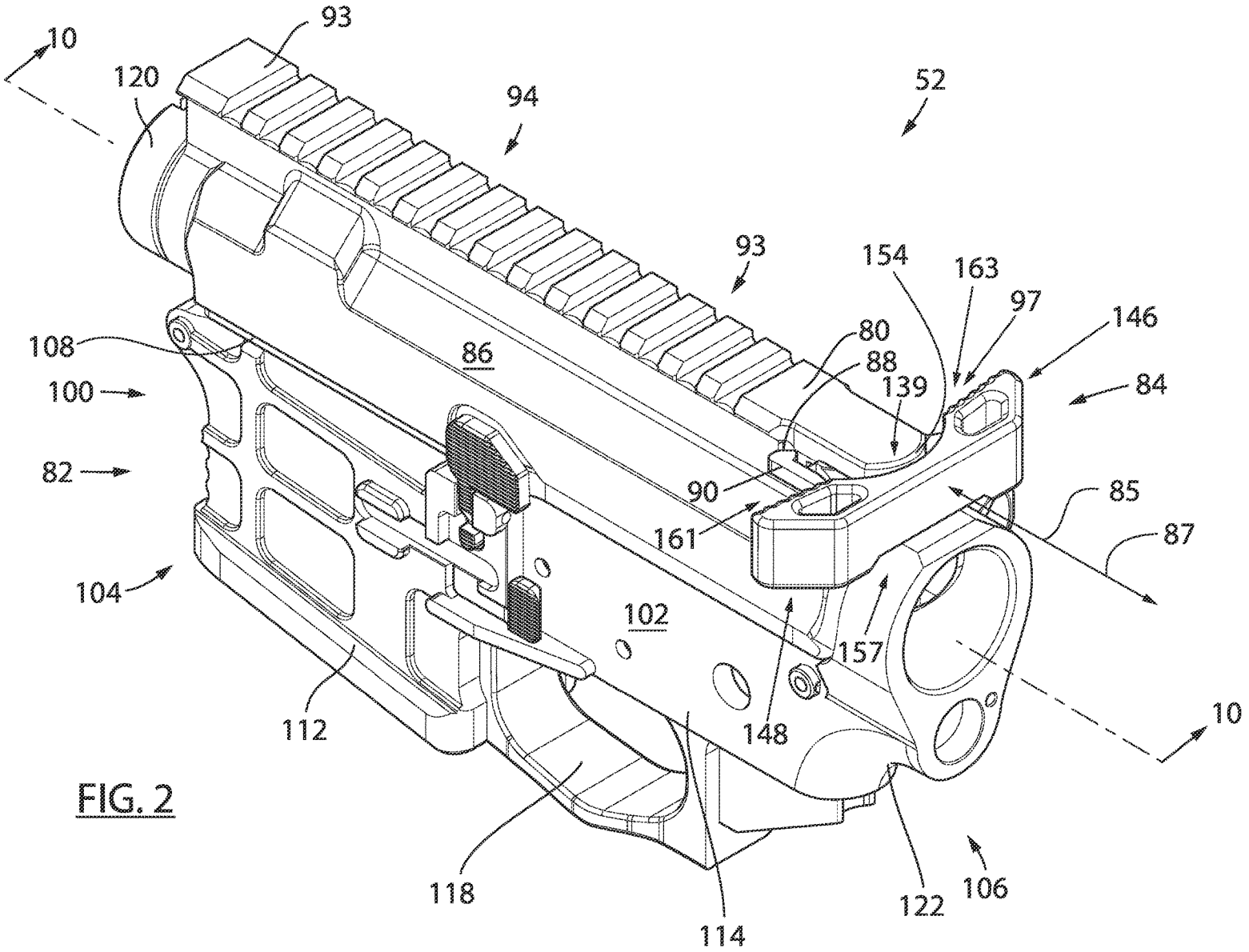
FIG. 2 is rear left side perspective view of the receiver and charging handle assembly shown in FIG. 1 with the barrel, stock, and shroud assemblies removed therefrom.

FIG. 2 shows the barrel, stock, and charging handle shroud 200 associated with firearm 40 removed from receiver assembly 52. Receiver assembly 52 includes an upper receiver 80, a lower receiver assembly 82, and charging handle assembly 84 that slidably cooperates with receiver assembly 52. Fore and aft, or forward and rearward, slideable cooperation of charging handle assembly 84 relative to receiver assembly 52; as indicated by arrows 85, 87, respectively; effectuates selective user access to the breech and firing chamber of the underlying firearm and operates to effectuate selective fore and aft translation of a bolt relative to receiver assembly 52. During manual operation of charging handle assembly 84 relative to receiver assembly 52, rearward translation 87 of charging handle assembly 84 effectuates opening of the action of the underlying firearm, ejection of a spent shell casing from the firing chamber, and/or removal of undischarged ammunition from the firing chamber. Forward translation 85 or "closing" of the charging handle assembly 84 relative to the receiver assembly 52 allows forward spring bias imparted to the bolt to close the action and thereby feed an initial round of ammunition to the firing chamber when available.

During sequential operation of firearm 40 attributable to user action of the trigger assembly 57, charging handle assembly 84 is commonly maintained in a "closed" orientation relative to underlying firearm 40 while the bolt moves in a sequential fore and aft manner to eject spent shell casings associated with discharge of an immediately preceding shell and introduction of a subsequent round of ammunition when available. In the exemplary embodiment, upper receiver 80 is defined by a body 86 and is shaped to facilitate slidable cooperation of charging handle assembly 84 relative thereto. Upper receiver body 86 can include one or more detents, cavities, or recesses 88 that are positioned and shaped to cooperate with a catch 90 associated with charging handle assembly 84. When engaged, cooperation between catch 90 and recess 88 secures charging handle assembly 84 in the forward or closed orientation relative to receiver assembly 52 of firearm 40.

As disclosed further below, although charging handle assembly 84 may be positioned in the relative "closed" position, byproducts associated with discharge of ammunition from firearm assembly may exit receiver assembly 52 about an interface 97 that generally surrounds the slideable interaction between charging handle assembly 84 and receiver assembly 52. The degree, relative location, and direction of shooting byproducts discharged from the firearm assembly can depend on the caliber of firearm discharged, quality of ammunition used, manufacturing tolerances employed to maintain the slidable cooperation of the charging handle assembly and the receiver assembly, age and usage of the underlying firearm assembly, operation of the firearm gas charging system associated with bolt oscillation, rate of fire, duration of operation, ambient conditions, and duration between cleaning events to name but a few.

Still referring to FIG. 2, an upper surface 93 of upper receiver 80 can include an optional engagement interface 94 associated with attaching one or more accessories associated with operation and/or usage of firearm 40. Upper receiver body 86 defines an ejection opening or port 96 (FIG. 3) oriented toward the right-hand side of receiver assembly 52 associated with discharging spent shell casings, removing non-discharged rounds, or facilitating access to the breech of firearm 40. Although shown as facing toward a right-hand side 98 of receiver assembly 52, it is appreciated that upper receiver body 86 can be constructed with a left side facing ejection port 96 or an ejection opening oriented toward a left-hand side 100 of receiver assembly 52 to better accommodate left-handed shooters.

Lower receiver assembly 82 is defined by a body 102 having a forward-facing end 104 and a rearward-facing end 106. As used herein, the relative forward, rearward, and right-hand and left-hand designations are used in relation to the users position relative to a discharge direction associated with muzzle 50 of firearm 40. An upper facing side 108 of lower receiver body 102 is shaped to removably cooperate with upper receiver body 86 whereas a lower facing side 110 of lower receiver body 102 defines a magazine portion 112, configured to removably cooperate with a magazine, and a trigger assembly portion 114, associated with accommodating a trigger assembly operative in response to actuation of trigger body 57 (FIG. 1).

Trigger assembly portion 114 of lower receiver body 102 defines a trigger guard 116 configured to generally circumscribes a trigger opening 118 that is configured to accommodate the user's interaction with trigger body 57 of firearm 40. Trigger guard 116 could be integrally formed with lower receiver body 102 or removable therefrom. It is further appreciated that trigger guard 116 could be formed as a portion of the trigger assembly configured to removably cooperate with lower receiver body 102. A forward-facing end 120 of upper receiver body 86 is constructed to cooperate with the barrel of firearm 40 and a rearward facing portion 122 of lower receiver body 102 is constructed to accommodate securing of a stock assembly to receiver assembly 52. Although described as being constructed of various discrete portions, such as upper and lower receiver portions 80, 82, as disclosed further below, it is appreciated that receiver assembly 52 could be provided with a more unitary or single body construction.

Figure 3:
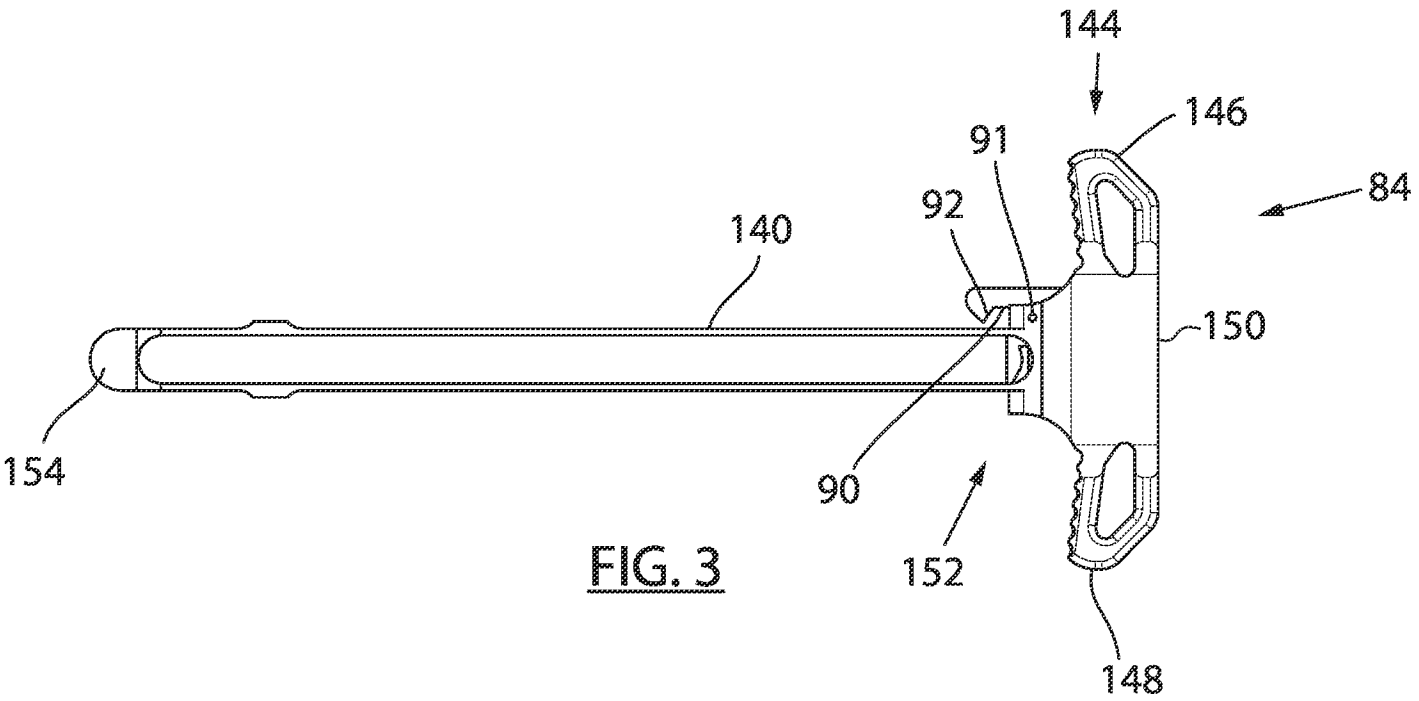
FIG. 3 a bottom plan view of the charging handle assembly shown in FIGS. 1 and 2 with the shroud removed therefrom and the charging handle assembly removed from the receiver assembly.

Referring to FIGS. 2 and 3, charging handle assembly 84 is generally defined by an elongate body 140 having a shaft portion 142 and a handle portion 144. When oriented in the "closed" or forward position relative to the underlying firearm 40 as shown in FIGS. 1 and 2, shaft portion 142 of charging handle assembly 84 is generally fully enclosed within receiver assembly 52. Handle portion 144 preferably includes one or more handles or pulls 146, 148 that extend in generally opposite lateral directions and that are oriented toward and accessible to the user of firearm 40. User interaction with one or each of pulls 146, 148 allows the user to manually retract the charging handle assembly 84 from the firearm 40 when desired.

A projection 154 extends in a crossing direction relative to a longitudinal axis defined by shaft 142 of charging handle assembly 84. Projection 154 is shaped to interact with the bolt of underlying firearm 40 such that rearward translation of charging handle assembly 52 relative to firearm 40 effectuates the rearward translation of the bolt and thereby "opens" the action and exposes the firing chamber of the underlying firearm 40 when desired. It is appreciated that charging handle assembly 84 shown in FIGS. 1-3 is exemplary of many commercially available changing handle assemblies. As disclosed further below, such assemblies may include various pull and latch constructions and configurations. Some such assemblies require user interaction with a lever arrangement to effectuate rearward translation of the changing handle assembly when associated with an underling firearm whereas other assemblies simply require user interaction with one of more discrete pulls of the charging handle assembly to overcome an initial bias associated with a respective latch or catch intended to maintain the respective charging handle assembly in a respective closed position relative to the underlying firearm when desired.

Handle portion 144 of charging handle assembly 84 is generally defined by a user or rearward facing surface 150 and a forward-facing surface 152. Forward facing surface 152 of handle portion 144 of charging handle assembly 84 is generally shaped to cooperate with a rearward facing surface 150 (FIG. 2) of receiver assembly 52 that generally defines a circumferential opening formed in the rearward facing surface of receiver assembly 52 and that is shaped to slideably receive the shaft portion 142 of charging handle assembly 84. As shown in FIG. 2, the slideable cooperation of charging handle assembly 84 with receiver assembly 52 defines a lower directed interface 157, an upper directed interface 159, and opposing left side interface 161 and right side interface 163 associate with providing the circumferential interface between the forward facing structures of charging handle assembly 84 and the rearward facing surfaces of receiver assembly when charging handle assembly 84 is oriented in the "closed" position relative to receiver assembly 52.

Catch 90 is pivotably connected via a pivot pin 91 to charging handle assembly 84 and includes a barb 92 that is shaped to cooperate with recesses 88 defined by receiver assembly 52 to selectively maintain charging handle assembly 84 in the "closed" orientation relative to receiver assembly 52 during operation of firearm 40. Preferably, catch 90 is biased toward shaft 142 such that barb 92 is biased into engagement with recesses 88 when charging handle assembly 84 is "closed" relative to the underlying firearm assembly and such that user interaction with one or more of handle pulls 146, 148 is required to effectuate disengagement of barb 92 from recesses 88 and rearward translation of charging handle assembly 84 relative to receiver assembly 52 to "open" the action associated with the underlying firearm assembly.

Even when closed, ammunition discharge byproducts associated with operation of firearm 40 can escape the confines of the receiver assembly via the various tolerances, gaps, or spaces associated with maintaining the slideable operation of charging handle assembly 84 relative to receiver assembly 52. The various interfaces 157, 159, 161, 163 associated therewith and thereby directed toward face 71 and eyes 73 of user 63. It is appreciated that other charging handle constructions can include alternate operating features associated with effectuating the selective engagement and disengagement of related catches 90, barbs 92, and recesses 88 of other respective charging handle assemblies to effectuate the selective translation of the respective charging handle assemblies relative to respective underlying firearm assembly. As disclosed further below, shrouds 200 according to the present invention are constructed to be employed with charging handle assemblies provided by original equipment manufacturers (OEM's) in a manner that does not negate or otherwise interfere with the intended operation of the respective charging handle assemblies and cooperation of the respective charging handle latch or catch arrangements between the respective charging handle assemblies and related or other third party receiver assemblies.

Figure 4:
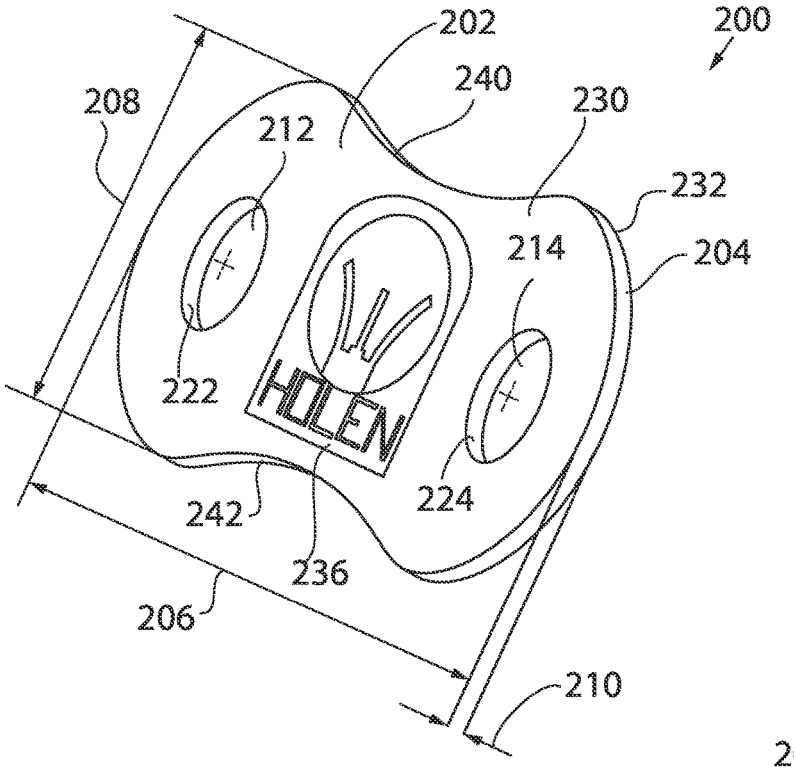
FIG. 4 is a perspective view of the firearm charging handle shroud shown in FIG. 1 exploded from the charging handle assembly.
Figure 5:
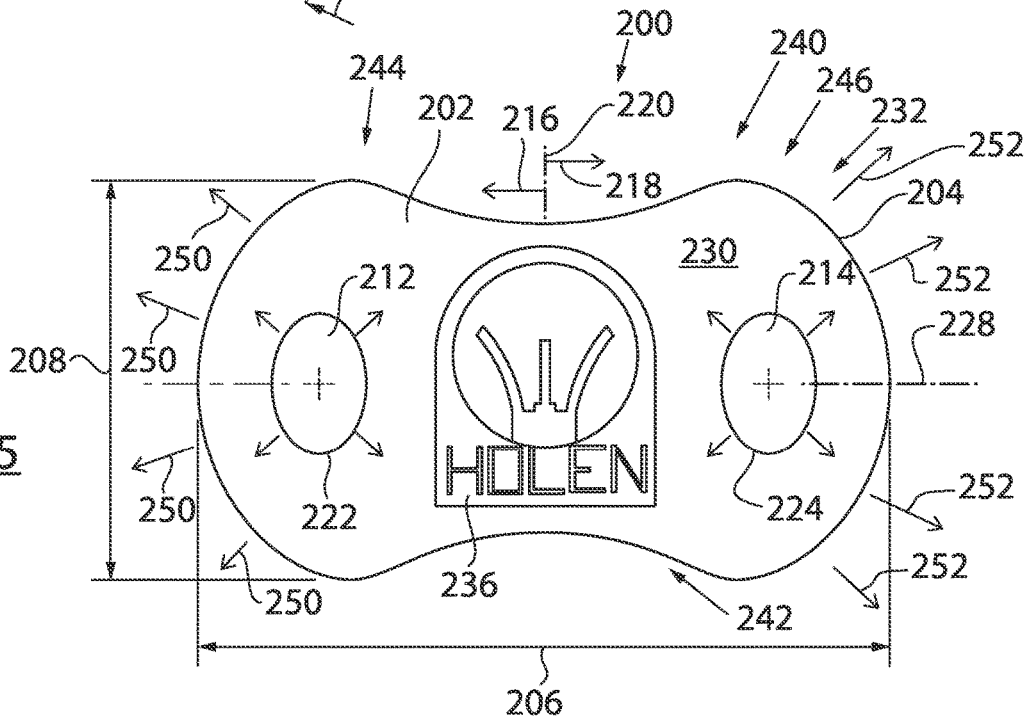
FIG. 5 is a rear or user facing side elevation view of the shroud shown in FIG. 4.

FIGS. 4 and 5 show alternate views of charging handle shroud 200 in an "at-rest" configuration prior to engagement of the respective charging handle shroud 200 with a respective charging handle assembly such as charging handle assembly 84. Charging handle shroud 200 is defined by a body 202 that is preferably formed of an elastomeric material. Preferably, body 202 is formed of a thermoplastic vulcanizate (TPV) material that is resistant to degradation due to friction wear, chemical attack due to contact with firearm cleaning and lubricating materials, ultraviolet light exposure, and degradation of the elastic performance of the body. The material preferably has operating tolerance temperatures of approximately −50 degrees Fahrenheit to approximately 275 degrees Fahrenheit, a shore durometer value of approximately 55-65 units, and tensile strengths of approximately 600 psi. One such material shown suitable for the formation of body 202 is manufactured by McMaster-Carr and marketed under the trade name Santoprene®. Such materials have shown suitable workability to form body 202 in various shapes suitable for cooperation with respective underlying charging handle constructions and capable of withstanding the rigors associated with extended periods of exposure and operation to a shooting environment and repeated operation of charging handles.

Body 202 is defined by a perimeter edge 204 that circumferentially bounds body 202 and defines a generally butterfly shape thereof. Body 202 is defined by a length 206, a width or height 208, and the thickness 210 bounded by edge 204. Respective passages or openings 212, 214 are formed through body 202. Openings 212, 214 extend in a direction that is aligned with thickness 210, the smallest dimension of body 202, and are disposed at respective locations that are laterally offset, indicated by arrows 216, 218 of a lateral centerline 220 of body 202. Openings 212, 214 are defined by respective walls 222, 224 of body 202 that extend in a direction across thickness 210 thereof.

Respective openings 212, 214 are preferably centrally disposed about a longitudinal centerline access 228 of body 202 and extend continuously through body 202 from a first or user facing side 230 of body 202 to a second or receiver facing side 232 thereof. Although openings 212, 214 are shown as having generally oblong cross-sectional shapes as shown in FIG. 5, it is appreciated that the shape of openings 212, 214, as well as the orientation of openings 212, 214 relative to centerlines 220, 228, may be provided in various relative orientations to effectuate the desired cooperation of body 202 of shroud 200 with a respective charging handle assembly such as charging handle assembly 84 as disclosed further below. User facing side 230 of body 202 may include signage 236 or the like indicative of a desired orientation of shroud 200 relative to the supplier of shroud 200 and/or the associated charging handle device and/or the owner of the underlying firearm assembly.

Body 202 may include one or more respective curved sections or cutouts 240, 242 defined by perimeter 204 and which configured to effectuate a desired positioning of body 202 relative to a respective charging handle assembly 84 as disclosed further below. Cutouts 240, 242 defined by perimeter 204 generally define respective lobes 244, 246 associated with the width or height 208 and length 210 of body 202 so as to define a generally "butterfly" shape thereof.

As disclosed above, body 202 of charging handle shroud 200 is constructed of an elastomer or stretchable material, such as thermoplastic vulcanizates (TPV) that are dynamically vulcanized alloys consisting mostly of fully cured EPDM rubber particles encapsulated in a polypropylene (PP) matrix, to allow the elastic the formation of body 202 of shroud 200 in respective outward lateral directions, as indicated by arrows 250, 252, to allow the selective engagement and/or disengagement of shroud 200 from an underlying charging handle assembly. Respective openings 212, 214 are each constructed to slidably cooperate with respective handle pulls 146, 148 defined by respective charging handle assemblies such as charging handle assembly 84 such that charging handle shroud 200 can be secured to a respective firearm charging handle assembly in a manner wherein portions of body 202 of charging handle shroud 200 extend beyond and deforms over the footprint defined by handle portion 144 of a respective charging handle assembly as disclosed further below.

Figure 6:
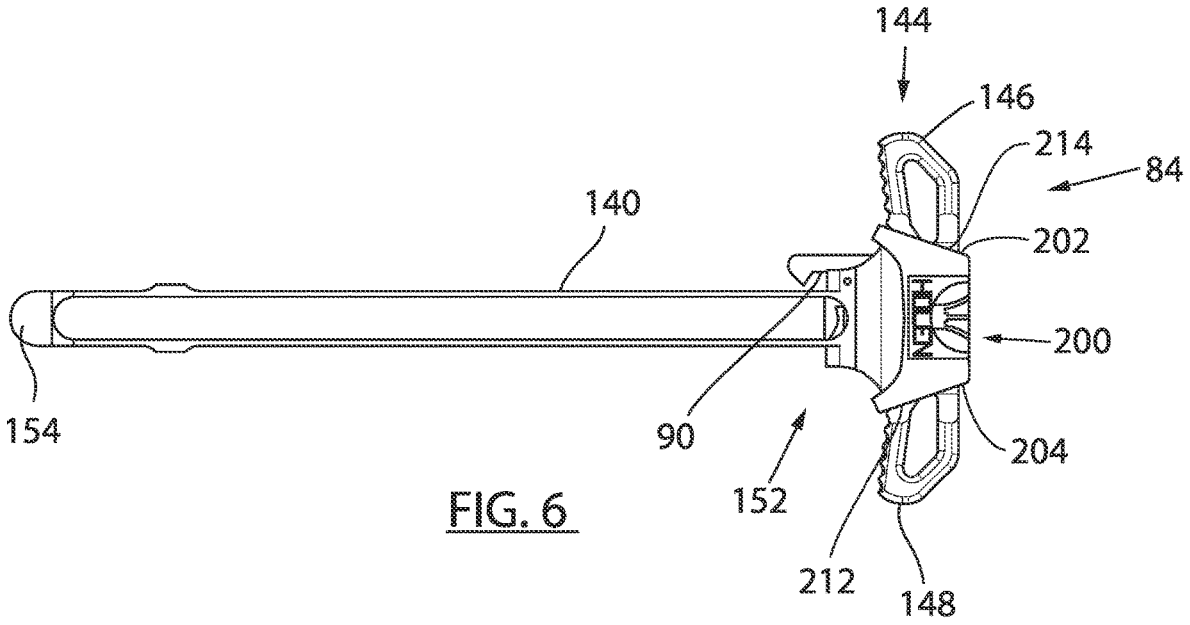
FIG. 6 is a bottom plan view similar to FIG. 3 with the shroud engaged with the charging handle assembly.
Figure 7:
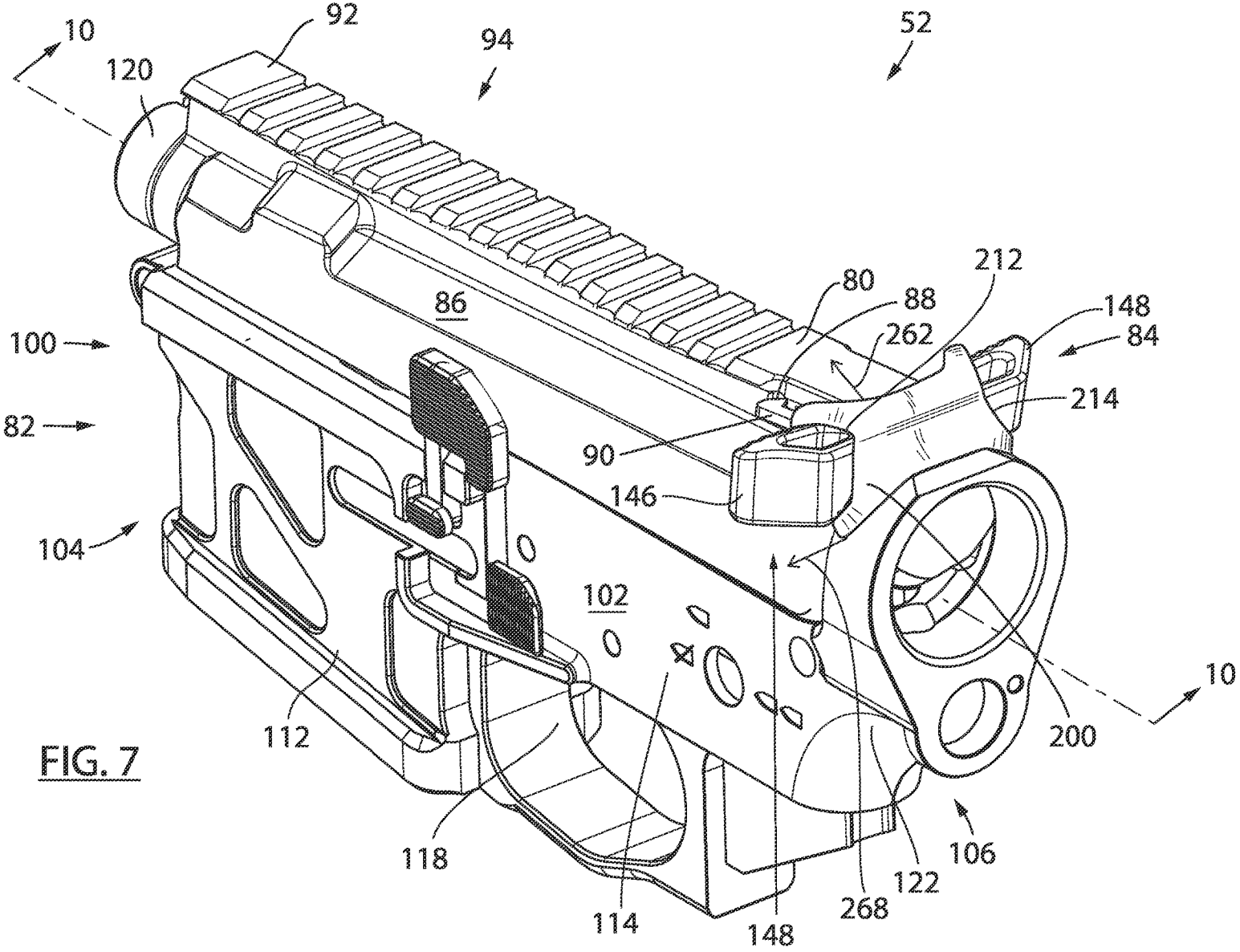
FIG. 7 is a view similar to FIG. 2 with the charging handle and shroud assembly shown in FIG. 6 engaged with a respective receiver assembly.

FIGS. 6 and 7 are respective views of charging handle shroud 200 engaged with charging handle assembly 84. As shown in FIG. 6, during use of shroud 200, opening 214 of shroud 200 is placed over first handle pull 146 of charging handle assembly 84. Opening 214 may or may not deform as handle pull 146 passes therethrough as a function of both the cross-section shape of handle pull 146 and the respective cross-sectional size of opening 214. Once engaged therewith, user tensioning of body 202 toward charging handle pull 148 allows deformation of body 202 until opening 212 can be associated with the opposing handle pull 148 such that opening 212 can circumferentially bound handle pull 148. Once openings 212, 214 are associated with handle pulls 146, 148, the user can centrally position shroud 200 along the rearward facing surface of charging handle assembly 84 such that shroud 200 can be tensioned thereacross by the elastic performance of thereof. Preferably, regardless of the left, right, or both operating nature of catch 90, openings 212, 214 can be disposed along the available longitudinal length of handle pulls 146, 148 such that shroud 200 does not interfere with the intended operation of catch 90 and/or the intended cooperation of catch 90 with the respective underlying receiver assembly.

As shown in FIG. 7, when engaged with charging handle assembly 84, shroud 200 extends generally beyond the discrete upper, lower, and edge interfaces defined by the slideable interfaces between OEM charging handle assembly 84 and corresponding receiver assembly 52. Said in another way, perimeter 204 of shroud 200 extends beyond the various lines of interface associated with the slideable interaction between the charging handle assembly 84 and receiver assembly 52. Further, the elastic nature of body 202 of shroud 200 and the forward oriented engagement of the opposing openings 212, 214 of shroud 200 with the discrete forward positioned handle pulls 146, 148 of charging handle assembly 84 impart a forward inclination to those portions of body 202 that are not directly restricted by interaction with the structure of charging handle assembly.

When employed, some receiver facing portions of shroud 200 may directly contact both the charging handle and the receiver on generally opposite sides of any gaps associated with the interfaces therebetween to provide a sealing operation thereat. other portions of shroud 200 may extend outward and beyond the adjacent structure of one of the receiver assembly and/or charging handle assembly. Such an orientation can allow partial venting of discharge byproducts at portions of the interfaces between the charging handle assembly of the receiver assembly. Proximate such locations, the elastic deformation of shroud 200 in forward inclined directions allows venting or deflecting of discharge products in directions indicated by arrows 266, 268 generally away for a user 63 associated with firearm 40.

Such considerations mitigate premature fouling of the interfaces between a respective charging handle assembly and an underlying firearm receiver assembly, mitigate premature degradation of the seal and deflection performance of shroud 200, allow shroud 200 to be employed with various OEM charging handle and receiver assembly configurations, allow mitigation of discharge byproducts being directed toward the face of the user during failure of other firearm assemblies, such as gas tube seals or gaskets associated with gas operation of the bolt, and allow shroud 200 to be quickly and conveniently associated with discrete firearm assemblies should a discrete firearm equipped with shroud 200 be rendered inoperable or unusable. Accordingly, firearm charging handle shroud 200 mitigates discharge byproducts egressing from an underlying firearm via the slideable interface between the charging handle assembly and an underlying receiver assembly from being directed toward the face of a user and does so in a manner wherein the shroud can be economically produced and acquired, cooperates with various OEM firearm assemblies, can be expeditiously transferred between discrete firearms, and does not interfere with or otherwise require alteration of an underlying OEM firearm assembly and/or discrete portions of the related subassemblies associated therewith.

Therefore, one embodiment of the present invention includes a firearm charging handle seal and diverter shroud that is constructed to removably cooperate with charging handles having a variety of constructions and that is operable to mitigate instances of blowback being directed toward a face of a user during operation of the underlying firearm. The charging handle shroud is defined by a body that is formed of an elastically deformable material. The shroud is constructed to be secured to a charging handle by respective left hand and right-hand charging handle pulls when a charging handle is operationally engaged with an underlying firearm. The shroud wraps generally about a rearward facing surface of a charging handle and is constructed to one or more of generally seal the lower oriented interface between a charging handle and an underlying receiver of a firearm and preferably extends above an upper surface of a rearward facing portion of the charging handle. During use, the shroud operates to prevent egress of gunshot residue from the firearm and/or divert gunshot residue that escapes the firearm from traveling in directions toward the face of a user of a firearm.

Another embodiment that includes features and/or aspects that are usable or combinable with other embodiments of the present invention includes a firearm charging shroud that is defined by a body formed by a flexible material. The body is defined by a thickness, a width, and a length wherein the thickness is oriented to be generally aligned with an axis associated with slidable operation of a charging handle engaged with a firearm. The width of the body is configured to be oriented in a generally vertical plane and is dimensioned to extend at least below a lower surface of a handle portion of a charging handle. The length of the body extends in a crossing direction relative to the width and the thickness of the body. A first opening and a second opening are formed through the body such that each opening extends in a direction aligned with the width of the body. The first opening and the second opening are oriented such that the first opening and the second opening are offset from one another along the length of the body. The first opening and the second opening are further oriented to be selectively engageable with a respective one of a left side pull and a right side pull of a respective charging handle to secure the body to an underlying firearm such that the body extends rearward of a charging handle.

A further embodiment that includes one or more features and/or aspects that are usable or combinable with one or more of the features, aspects, and/or embodiments disclosed above includes a firearm charging handle shroud having a body that is formed of a flexible material and having a unitary construction. A first opening and a second opening are formed through the body at generally opposite longitudinal ends thereof. Each of the first opening and the second opening are constructed to receive a respective charging handle pull therethrough and are spaced from one another such that a portion of the body between the first opening and the second opening elastically deforms when the first opening and the second opening are engaged with a respective charging handle.

Another embodiment that is usable or combinable with one or more of the features, aspects, and/or embodiments disclosed above includes a method of manipulating direction of travel of gunshot residue discharged from the interface between the charging handle and receiver assemblies of a firearm. The method includes providing a body that is formed of a flexible material. The method further includes shaping the body to removeably cooperate with a charging handle of a firearm such that, when engaged with a respective charging handle, the body wraps about a rearward facing portion of a charging handle when a charging handle is engaged with a firearm. When engaged with a respective charging handle, an upper edge and a lower edge of the body extends beyond respective upper and lower edges of a rearward facing portion of a charging handle engaged with a firearm.

The present invention has been described in terms of the preferred embodiments. The several embodiments disclosed herein are related as being directed to the device and method of forming such a firearm charging handle shroud as generally shown in the drawings. It is recognized that equivalents, alternatives, and modifications, aside from those expressly stated, the embodiments summarized, or the embodiment shown in the drawings, are possible and within the scope of the appending claims. It is further appreciated that aspects of the multiple embodiments are not specific to any of the particular embodiments and may be applicable between one or more of the disclosed embodiments. The appending claims cover all such alternatives and equivalents.

What is claimed is:

1. A firearm charging handle shroud comprising:

a body formed by a flexible material and defined by a thickness, a width, and a length and wherein the thickness is oriented to be generally aligned with an axis associated with slidable operation of a charging handle engaged with a firearm, the width is configured to be oriented in a general vertical plane and is dimensioned to extend below a lower surface of a handle portion of a charging handle, and the length extends in a crossing direction relative to the width and the thickness of the body;

wherein at least one of an upper edge and a lower edge of the body curves toward the other of the upper edge and the lower edge of the body;

a first opening formed through the body and extending in a direction aligned with the width; and a second opening formed through the body and extending in the direction aligned with the width and such that the first opening and the second opening are offset from one another along the length of the body and such that the first opening and the second opening can be selectively engaged with a respective one of a left side pull and a right side pull of a charging handle to secure the body rearward of a charging handle.

2. The firearm charging handle shroud of claim 1 wherein the first opening and the second opening are formed through the body a same distance from a respective one of a first end and a second end of the body along the length of the body.

3. The firearm charging handle shroud of claim 1 wherein the first opening and the second opening have similar diameters.

4. The firearm charging handle shroud of claim 1 wherein each of the upper edge and the lower edge of the body curve toward the other of the upper edge and the lower edge of the body.

5. The firearm charging handle shroud of claim 1 wherein the body is formed of thermoplastic vulcanizate material.

6. A firearm charging handle shroud comprising:

a body formed of a flexible material and having a unitary construction; and a first opening and a second opening formed through the body at generally opposite longitudinal ends thereof, each of the first opening and the second opening being constructed to receive a respective charging handle pull therethrough and spaced from one another such that a portion of the body between the first opening and the second opening elastically deforms and extends beyond a rearward facing footprint defined by a charging handle underlying the portion of the body between the first opening and the second opening and such that the body is incapable of manipulating slidable operation of a charging handle relative to an underlying firearm when the first opening and the second opening are engaged with a charging handle.

7. The firearm charging handle shroud of claim 6 wherein at least one edge of the body that extends between the opposite longitudinal ends is curved.

8. The firearm charging handle shroud of claim 7, wherein each edge of the body that extends between the opposite longitudinal ends is curved toward an opposite edge.

9. The firearm charging handle shroud of claim 6 wherein the first opening and the second opening are elastically deformed when engaged with a respective charging handle pull.

10. The firearm charging handle shroud of claim 6 wherein the body has a width that is greater than a height of a charging handle proximate respective charging handle pulls.

11. The firearm charging handle shroud of claim 6 wherein the body is formed of thermoplastic vulcanizate material.

12. The firearm charging handle shroud of claim 6 further comprising a charging handle having a first charging handle pull constructed to engage the first opening and a second charging handle pull constructed to engage the second opening.

13. The firearm charging handle device of claim 12 further comprising a firearm assembly that is constructed to slideably cooperate with the charging handle.

14. A method of manipulating direction of travel of gunshot residue, the method comprising:

providing a body formed of a flexible material;

shaping the body to removeably cooperate with a charging handle of a firearm such that the body wraps about a rearward facing portion of a charging handle when a charging handle is engaged with a firearm such that an upper edge and a lower edge of the body extend beyond respective upper and lower edges of a rearward facing portion of a charging handle engaged with a firearm.

15. The method of claim 14 further comprising forming a first opening in a first end of the body and forming a second opening in a second end of the body wherein each of the first opening and the second opening are shaped to removably cooperate with a respective pull handle defined by a charging handle.

16. The method of claim 15 further comprising positioning each of the first opening and the second opening in the body so that the body does not interfere with operation of a latch associated with a changing handle.

17. The method of claim 15 further comprising positioning each of the first opening and the second opening in the body so that a portion of the body between the first opening and the second opening is tensioned when the first opening and the second opening are each engaged with a respective pull handle defined by a charging handle.

18. The method of claim 17 further comprising shaping the body to extend at least one of above and below a respective edge defined by a rearward facing portion of a charging handle.

19. The method of claim 14 further comprising forming the body of a thermoplastic vulcanizate material.

* * * * *